US005207403A

United States Patent [19]

Penniman

[11] Patent Number: 5,207,403

[45] Date of Patent: May 4, 1993

[54] DEVICE AND METHOD TO SUPPORT POLYETHYLENE OR OTHER SHEETING

[76] Inventor: David T. Penniman, Roaring Brook Rd., Prospect, Conn. 06712

[21] Appl. No.: 818,778

[22] Filed: Jan. 13, 1992

Related U.S. Application Data

[63] Continuation-in-part of Ser. No. 619,042, Nov. 28, 1990, abandoned, which is a continuation-in-part of Ser. No. 432,532, Nov. 7, 1989, abandoned.

[51] Int. Cl.[5] ..... A47B 96/06

[52] U.S. Cl. ..... 248/215; 248/301

[58] Field of Search ..... 248/682, 684, 301, 317, 248/339, 231.9, 227, 228, 215, 493

[56] References Cited

U.S. PATENT DOCUMENTS

| | | | |
|---|---|---|---|
| 1,651,392 | 12/1927 | Honigbaum | 248/301 X |
| 2,264,666 | 12/1941 | Hexdall | 248/301 X |
| 2,672,314 | 3/1954 | Mitchell | 248/301 |
| 3,018,080 | 1/1962 | Loudon | 248/228 |
| 3,124,327 | 3/1964 | Meszaros | 248/301 X |
| 3,276,800 | 10/1966 | Loudon | 248/228 |
| 3,561,718 | 2/1971 | Iverson | 248/301 |
| 4,315,611 | 2/1982 | Hoop | 248/228 X |
| 4,736,917 | 4/1988 | Thuresson . | |
| 4,811,475 | 3/1989 | Morton | 248/546 X |
| 4,858,871 | 8/1989 | Romano | 248/301 X |

FOREIGN PATENT DOCUMENTS

| | | | |
|---|---|---|---|
| 115082 | 5/1942 | Australia | 248/231.91 |
| 236174 | 6/1911 | Fed. Rep. of Germany | 248/301 |

*Primary Examiner*—J. Franklin Foss
*Attorney, Agent, or Firm*—CTC & Associates

[57] ABSTRACT

An improved device for piercing and supporting sheeting from a previously installed ceiling grid molding and method for a single worker to install and seal sheeting around the periphery of a room to isolate the room for asbestos removal.

3 Claims, 5 Drawing Sheets

DEVICE AND METHOD TO SUPPORT POLYETHYLENE OR OTHER SHEETING

RELATED APPLICATION

This is a continuation-in-part of copending U.S. patent application Ser. No. 07/619,042 filed Nov. 28, 1990, herewith abandoned which was a continuation-in-part of then copending U.S. patent application 07/432,532 filed Nov. 7, 1989, now abandoned.

BACKGROUND OF THE INVENTION

Extensive use of asbestos for thermal insulation and reinforcement of polymers such as in floor tiles and roofing shingles occurred during the first two thirds of the twentieth century. That practice ceased when it was found that asbestos fiber was considered to be carcinogenic. In fact, there is great concern that previously installed asbestos products within buildings may shed sufficient asbestos fiber to cause cancer to the building's inhabitants. Therefore, the Federal and subsequently State governments enacted legislation stipulating the procedures to be used for such removal to prevent the inadvertent diffusion of asbestos fiber throughout a building.

Asbestos removal in a building requires the physical isolation of the area in which such work is accomplished. In addition, such isolated areas must be maintained with negative air pressure so that any inadvertent release of asbestos fiber will remain in the isolated area to be filtered and collected for later safe disposal.

The area isolation method stipulated by most states requires the installation of two layers of either four or six mil polyethylene sheeting on each wall. Such sheets of polyethylene are very slippery and difficult to handle. Each of these layers must be sealed at the wall interfaces of the ceiling and floor. Ideally the sheets of polyethylene will extend around all of the walls of the isolation area to be joined at a single overlapping seam. When asbestos is removed from a ceiling or ceiling fixtures the floor must be covered with two layers of six mil polyethylene sheeting which extends up a wall and is sealed at the wall floor interface. Each layer or sheet is individually taped to the wall. In such instance the sheeting installed on the wall is applied after the installation of the floor sheeting.

As can be envisioned, the installation of such two individual layers of slippery sheeting continuously around an enclosed area utilizing nailed on furring strips or spray on adhesive requires several workers working in concert and as such is very labor intensive and frustrating for the installers; in many instances requiring reinstallation when it is found that the isolation is not complete.

The art of the instant invention utilizes special hangers which can conveniently be non-destructively installed around the walls of an area to be isolated on the wall at the ceiling and wall interface. Polyethylene sheeting of sufficient width to extend to the floor is then hung on the hangers. Flexible pressure sensitive tape is then applied to the top edge of the sheet to bond it to the wall/ceiling. Subsequently, the bottom edge of the polyethylene sheet is adhered in like manner to the wall at the wall/floor interface. The second layer of polyethylene sheeting is installed in like manner. The second sheeting layer being somewhat narrower in width so as to permit the pressure sensitive tape to be applied to the first previously installed layer of tape at both the floor and ceiling interfaces.

OBJECT OF THE INVENTION

It is an important object of the invention to provide a simple, low cost, effective, improved hanger device on which to impale and support multiple layers of 4 or 6 mil (0.004 or 0.006 inch-0.1 and 0.15 mm) polyethylene sheeting immediately adjacent to and in contact with a wall so that each layer of sheeting may be individually sealed to the wall/ceiling with pressure sensitive tape without interference of the improved hanging device.

It is another important object of the invention to provide a simple method which requires only a single worker to seal multiple layers of polyethylene to the walls/ceiling and walls/floor of an enclosure to isolate an area for asbestos removal.

It is yet another object of the invention wherein the improved hanging device which supports multiple layers of polyethylene sheeting without tearing of the sheeting either during installation, while removing asbestos contaminated materials such as asbestos floor tile which has been bonded to the floor, and during removal of the sheeting during cleanup.

PRIOR ART

A. Installation Art

The first such prior art technique for supporting polyethylene sheeting on walls uses duct tape in conjunction with spray glue which is first sprayed onto the walls to increase the adhesion between the duct tape and the wall/ceiling surface. The adhesion of the duct tape alone is sometimes lacking, resulting in the polyethylene sheeting falling down during asbestos removal, and allowing asbestos fibers to contaminate the wall surface. Additionally, the use of duct tape and spray glue causes extensive damage to wall-papers or painted surfaces, and requires extensive labor to repair or clean off such surfaces such as concrete or tile.

The second such prior art technique for supporting polyethylene sheeting is to nail or screw wood furring strips to the wall surfaces and then staple and tape polyethylene sheeting to the furring strips. This technique damages wall surfaces requiring substantial amounts of labor to repair such damage.

B. Hanging devices

The following art has previously been disclosed and or cited during the examination of U.S. patent application Ser. No. 07/619,042.

| U.S. Pat. No. | Inventor | Issue Date |
|---|---|---|
| 1,651,392 | Honigbaum | December 6, 1927 |
| 2,264,666 | Hexdal | December 2, 1941 |
| 2,672,314 | Mitchell | March 16, 1954 |
| 3,018,080 | Loudon | January 23, 1962 |
| 3,124,327 | Meszaros | March 10, 1964 |
| 3,276,800 | Loudon et al. | October 4, 1966 |
| 4,315,611 | Hoop | February 16, 1982 |

German Patent 236,174 (Design), Summerfield, Jun. 30, 1911.

Honigbaum teaches an improved shingle retainer.

Hexdall teaches a hanger for supporting sheet metal ducts.

Mitchell teaches hangers suitable for hanging telephone wires and the like which are particularly suitable for mounting against asbestos siding covered house walls.

Loudin (U.S. Pat. No. 3,018,080) is a scissor like device for clamping engagement with the horizontal portion of a T-shaped rail member.

Meszaros teaches a supporting bracket to support Christmas lights on the exterior of a house.

Loudon et al. (U.S. Pat. No. 3,276,800) teaches a threadingly tightened spring clip for fastening to flanges of structural beams or other structural members with free edges.

Hoop teaches a device with oppositely opposed flange engaging ceiling channel members.

Summerfield (no text available—only drawing) appears to teach a flat metal plate from which a portion has been struck to form a sharp horizontal prong and which has two holes located in the same plane somewhat above the horizontal prong.

None of the above art appears to reflect the improved hanging device of the instant invention or the method to suspend and seal polyethylene sheeting to the wall at the wall/ceiling interface.

SUMMARY OF THE INVENTION

This invention relates to a method and improved hanging device to support sheeting in a vertical plane around the perimeter of an area to be isolated for asbestos removal and to transmit the weight of the sheeting and pressure exerted by negative air pressure to previously installed building components in such manner that the sheeting may be sealed to a wall at the wall/ceiling intersection with pressure sensitive tape such as duct tape without interference of the hanging device.

The improved hanging device includes a planar base or plate of substantially rigid material such as metal or some types of rigid plastic. A prong extends from a first side of the planar base The prong has a flat land substantially perpendicular to the planar base or plate so that when installed in a vertical position the land is substantially horizontal. The prong also has a second portion integral with the land and making an obtuse angle in relationship with the land terminating in a pointed free end remote from the land. The pointed free end of the prong points away from the planar base. It is also located toward the lower end of the planar base when installed in a vertical position. The pointed free end of the prong serves to easily pierce the sheeting and to support the same on its horizontal land without tearing of the sheeting when its full weight is placed thereon. The horizontal land of the prong is particularly useful to support a second sheet without tearing so that both sheets may individually be sealed to the adjacent wall with pressure sensitive tape.

The improved device has a second component which may conveniently be used to non-destructively slip onto or behind the well known wall molding of, for example, a grid to support ceiling tiles.

In one form, the upper end of the plate is shaped to form a clip on the first side of the plane. The clip has a lower leg portion integral with and perpendicular to the flat portion of the plate or planar base, an arcuate portion of substantially 180 degrees arcuate extent remote from the flat portion and integral with the lower leg portion and an upper leg portion integral with the arcuate portion and overlying and substantially parallel to the lower leg portion, with a gap between the leg portions. The upper leg portion extends from the arcuate portion to a free edge, and the upper leg portion does not cross the plane of the planar base. The plate can be assembled with the horizontal leg of a wall molding of existing structure, without threadingly or other means of tightening, with a leg of the wall molding in the gap between the leg portions of the clip, thus to support by gravity the device and multiple layers of sheeting which have been impaled on the prong.

In another form of supporting means, a barb is struck from the plane of the flat portion of the plate on the first side thereof and having a straight free edge confronting and spaced from the prong. The plate is slideably insertable behind an existing wall molding such that the barb engages the top edge of the wall molding to support the plate and the weight of sheeting which is impalable on the prong as aforesaid.

In still a further form of supporting means, the flat portion of the plate may have a hole therethrough which allows the plate to be nailed or screwed to a building component in the event there is no molding extending on a wall.

In each instance the device is of one piece construction, and it is to be noted that the device may include more than one form of supporting means.

The method of isolating an area by a single worker entails the installation of improved hanging devices of the invention at the juncture of the wall of ceiling of, for example, around the perimeter of a room that is to be isolated at approximately 3 ft. (2.7 meter) intervals. A first precut layer of sheeting is impaled on the prong of the improved hanging device approximately 3 inches (7.62 cm) from the edge of the sheeting. The sheeting coming to rest on the land portion of the prong. This is repeated until the sheeting extends around the perimeter of the room. The worker than tapes the upper edge of the sheeting to the wall with pressure sensitive tape and over the installed, improved device above the land of the prong which supports the sheeting. After completing the sealing of the first layer of sheeting at the wall/ceiling juncture it is sealed to the wall at the juncture of the wall and floor. The above is repeated for a presized second layer of sheeting except that it is sized to be slightly smaller in vertical length so that the tape may be applied onto the first layer of tape.

DETAILED DESCRIPTION OF THE INVENTION

Figure 1:
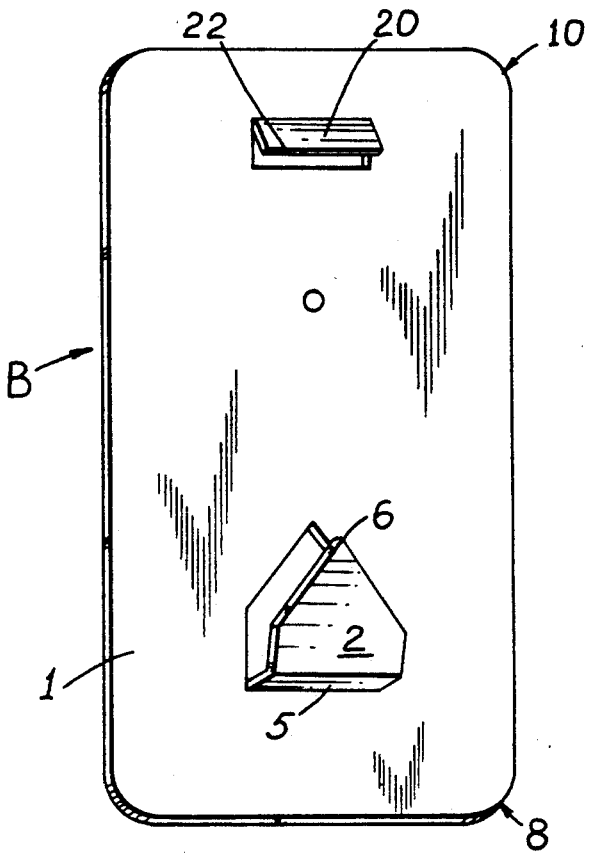
FIG. 1 is an isometric view of a first version of improved hanger with a barb extending from its upper portion.
Figure 2:
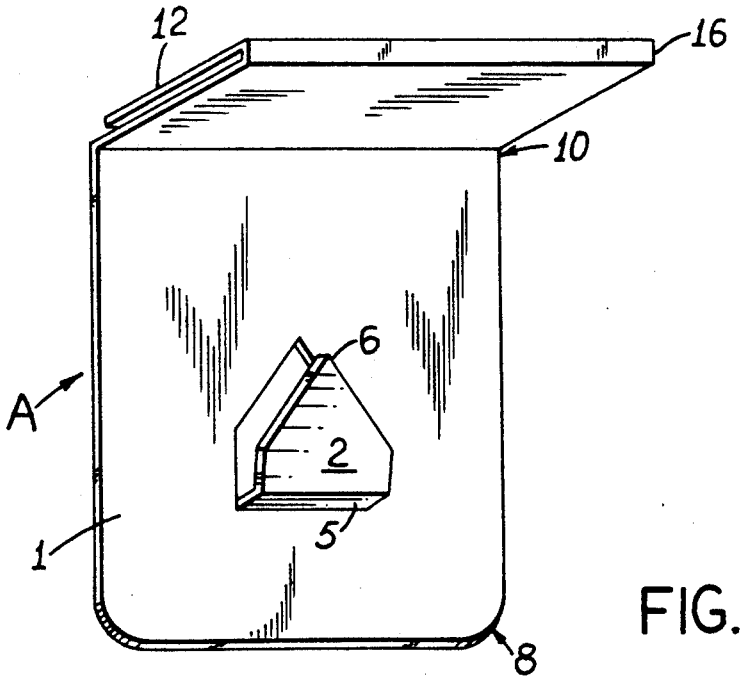
FIG. 2 is an isometric view of a second version of the improved hanger with a clip member.
Figure 3:
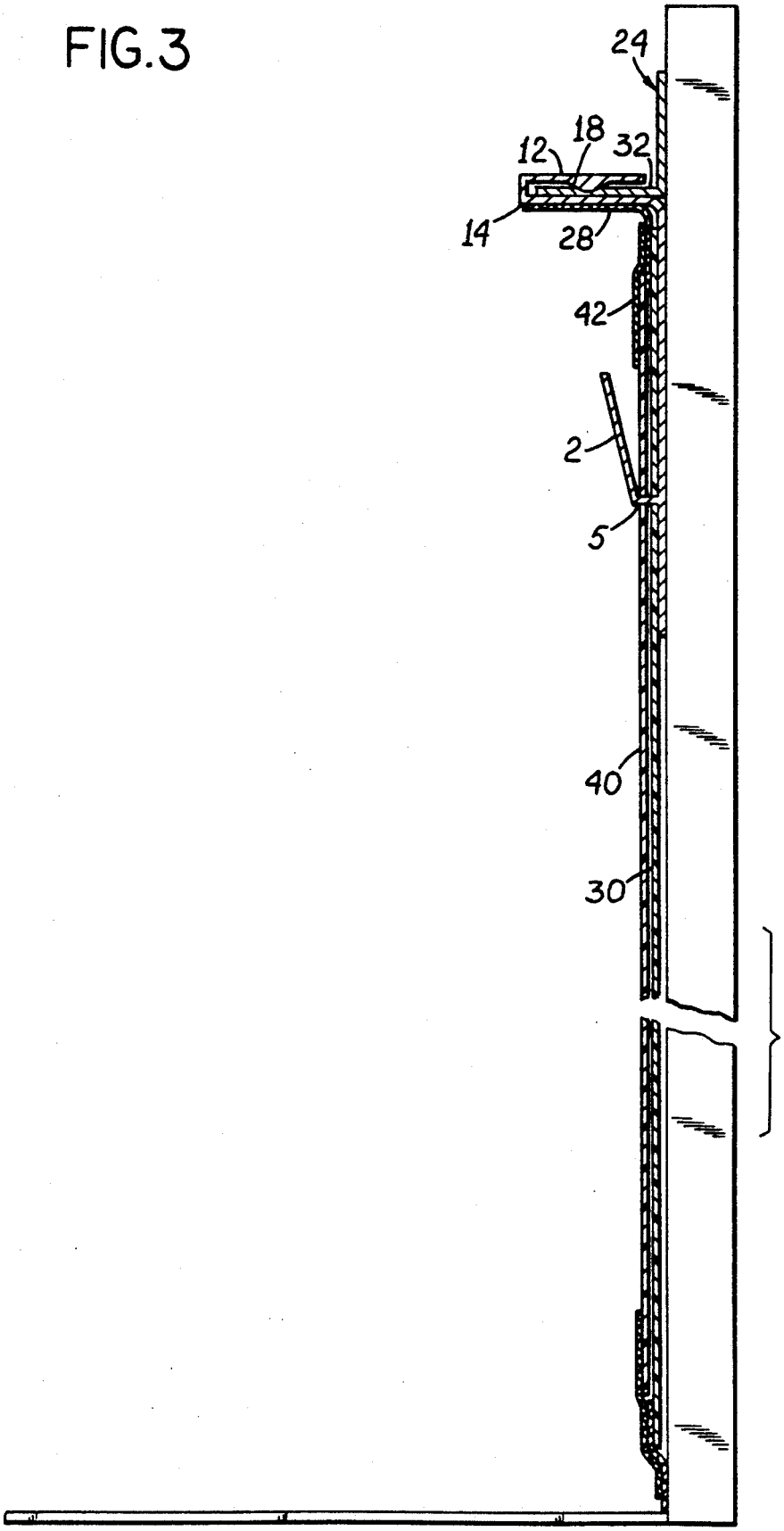
FIG. 3 is a side view of the hanger with clip member with two layers of polyethylene being supported therefrom with sealing tape in place.

FIGS. 1, 2 and 3 show a device that is a first preferred embodiment of the invention, furnishing a support for sheeting, such as polyethylene sheeting, and to transfer the weight of the sheeting to a component of an existing building. The device is of one-piece construction and includes a plate A of substantially rigid material such as metal or rigid plastic. Plate A has a flat portion 1 lying in a plane with a prong 2 struck from flat portion 1, and located on a first side of the plane of flat portion 1. Prong 2 has a first portion or land 5 substantially perpendicular to the plane of flat portion 1, such that when flat portion 1 is vertical, land 5 is substantially horizontal. Prong 2 also has a second portion integral with land 5 and making an obtuse angle with land 5 and an acute angle with the plane of flat portion 1 and terminating in a pointed free end 6 remote from land 5.

The obtuse angle mentioned in the preceding paragraph may be on the order of 100 degrees to 105 degrees and pointed free end 6 in general points away from a first or lower end 8 of plate A and toward a second or upper end 10 of plate A.

Pointed free end 6 of prong 2 serves to pierce the sheeting and allow the same to be supported on land 5.

Plate A FIG. 2 includes supporting means whereby plate A is supportable by a building component. The supporting means of plate A is provided by a clip adjacent upper end 10. The clip is located on the first side of the plane of flat portion 1 and has a lower leg portion 14 integral with and perpendicular to flat portion 1, an arcuate portion 16 of substantially 180 degrees arcuate extent remote from flat portion 1 and integral with lower leg portion 14 and an upper leg portion 12 integral with arcuate portion 16 and overlying and substantially parallel to lower leg portion 14, with a gap between leg portions 14 and 12. Upper leg portion 12 extends from arcuate portion 16 to a free edge, but does not cross the plane of flat portion 1. The length of leg portions 12 and 14 are such to permit flat portion 1 to contact the wall.

Upper leg portion 12 has a detent 18 downwardly protruding toward lower leg portion 14 to firmly engage horizontal member of ceiling molding.

FIG. 1 shows a one-piece device that is a second preferred embodiment of the invention, including a plate B of substantially rigid material such as metal or rigid plastic. Plate B has a flat portion 1 from one side of the plane from which is struck a prong 2 with a first portion or land 5 and a second portion integral with land 5 and extending to a pointed free end 6.

Plate B further has a barb 20 struck from the plane of flat portion 1 and on the same side of that plane and having a straight free edge 22 confronting and spaced from prong 2.

Figure 4:
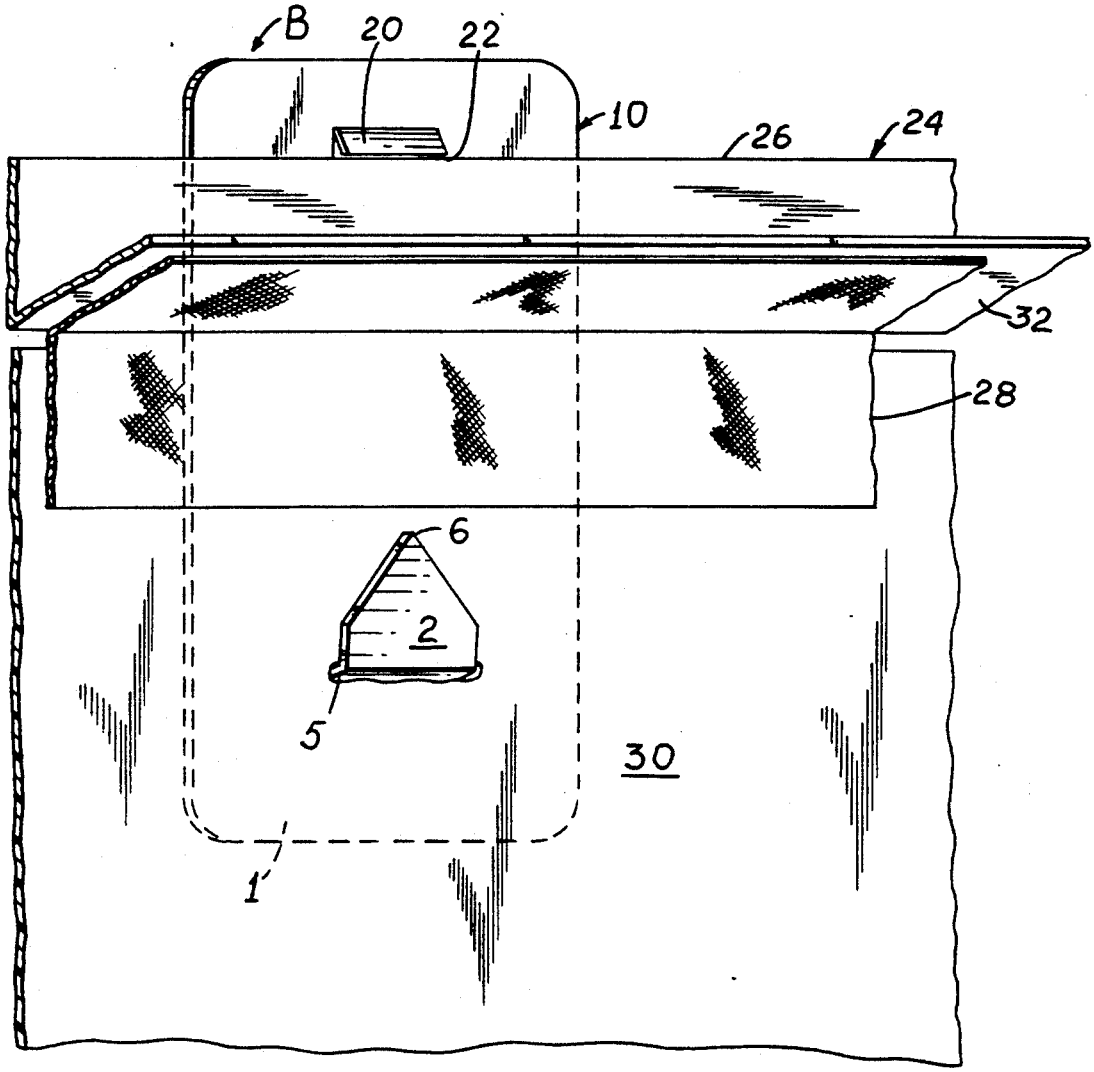
FIG. 4 is an isometric view of the improved hanger partially shown in phantom with barb member supporting a layer of sheeting sealed to the wall and ceiling molding.
Figure 5:
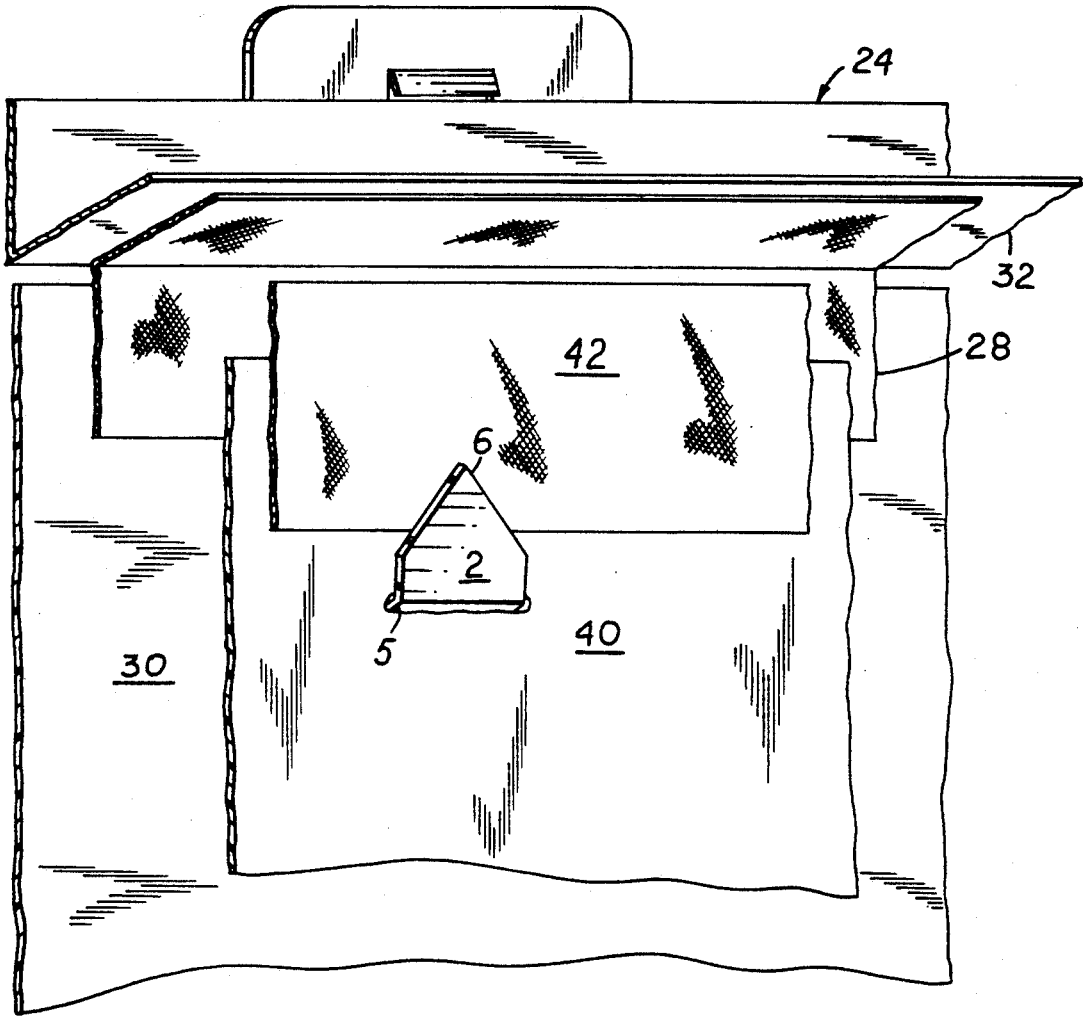
FIG. 5 is an isometric view of the improved hanger with two individual layers of sheeting being supported thereon and sealed to the ceiling molding.

Plate B (FIG. 4) also has a lower end 8 and an upper end 10 which is insertable behind an existing wall molding 24 such that tab 20 engages a top edge of a vertical leg 26 of molding 24 to support Plate B, as shown in FIG. 4. FIG. 5 shows polyethylene sheeting 30 impaled on prong 2 resting on land 5. Duct tape 28 is applied to the upper edge of sheeting 30 sealing it to the horizontal portion 32 of wall molding 24. A second layer of sheeting 40 (FIG. 5) is shown installed with a second layer of duct tape 42 to the top of sheeting 40 and onto first applied duct tape 28 to seal the second layer of sheeting to the first layer of sheeting on horizontal portion 28 of wall molding 24.

Figure 6:
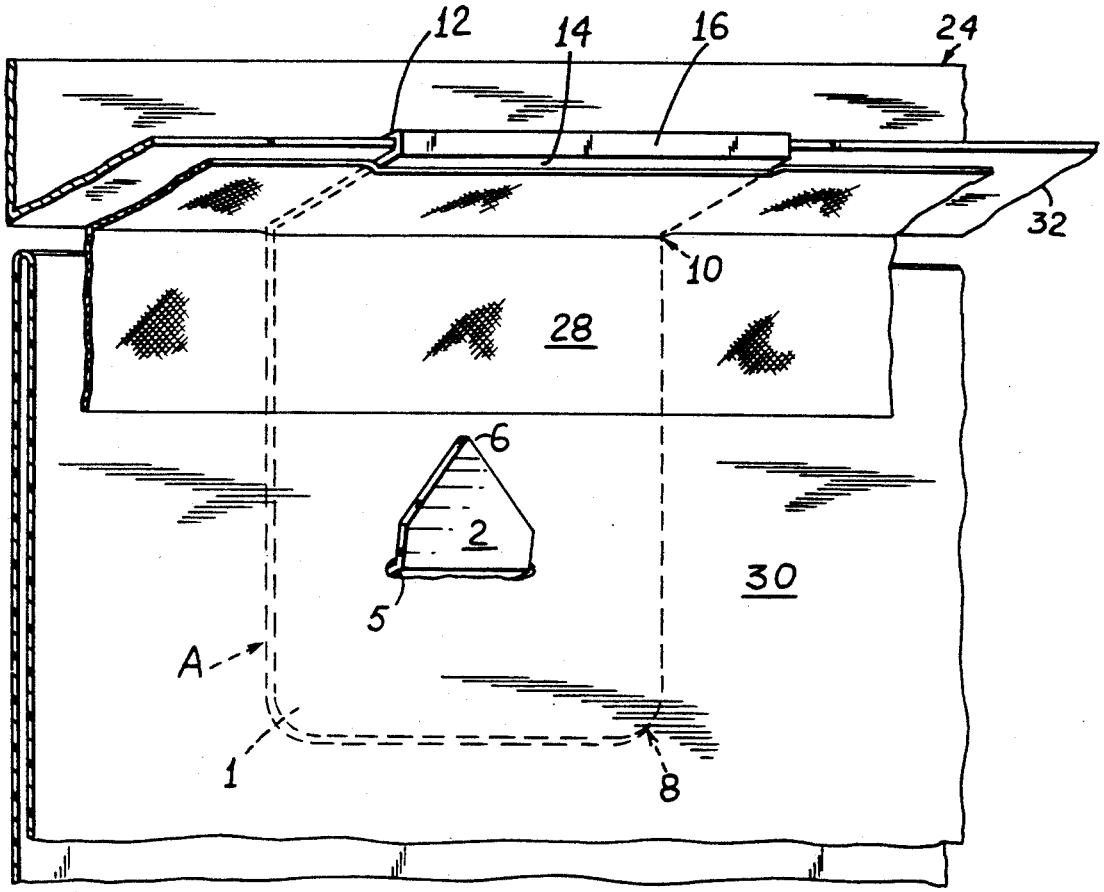
FIG. 6 is an isometric view of the improved hanger with clip member partially shown in phantom installed on ceiling molding with a double layer of sheeting installed, supported by barb and sealed with duct tape to the wall and ceiling molding.

As shown in FIG. 3, plate A can be assembled with a horizontal leg 32 of a wall molding 24 of existing structure with leg 32 in the gap between leg portions 12 and 14. In this condition, leg 32 of the wall molding 24 will engage detent 18, thus enabling plate A to support the sheeting 30 which is impaled on prong 2, as seen in FIG. 6 in which duct tape has been applied to the upper edge of sheeting 30 and a second layer of sheeting 40 is applied over first sheeting 30 and sealed with a second layer of duct tape 42 to horizontal molding 24.

Plate A (FIG. 6) is shown installed on the horizontal portion 32 of the ceiling molding 24 with one layer of polyethylene sheeting 30 being supported by land 5 of prong 2 and sealed by duct tape which extends over lower side 14 to seal both the sheeting and improved holder to the horizontal portion of the molding.

It is apparent that the invention attains the aforesaid objects and advantages among others.

The disclosed details are exemplary only and are not to be taken as limitations on the invention except as those details may be included in the appended claims.

What is claimed is:

1. A method for a single worker to install two layers of presized sheeting at the ceiling/wall juncture and at the wall/floor juncture around the perimeter of a room or other area to be isolated for asbestos removal comprising the slideable installation of improved hangers of this invention on or behind ceiling molding in contact with said walls at intervals around the perimeter of the area to be isolated, installing said first layer of sheeting on said improved hangers by piercing said sheeting on the prong of pushing sheeting to rest on the land of said prong, so that the upper edge of said sheeting extends upward to said ceiling, said sheeting being fully supported without tearing, sealing said sheeting to said ceiling molding with duct tape then sealing said lower edge of said sheeting to the juncture of the wall and floor with said duct tape.

2. An improved one piece device for piercing and hanging sheeting from an installed ceiling grid member, said device has a prong means to pierce and hang said sheeting and a means to engage said installed ceiling grid member, said improvement comprises a means to non-destructively slideably engage said ceiling grid member, said device hanging sheeting in contact with a wall onto which said ceiling grid member was installed so that said one piece device and said hanging sheeting may be sealed to said wall and said ceiling grid member by the application of pressure sensitive tape over said sheeting and device, said sealing of said device and said sheeting acting to isolate said wall as required for asbestos removal;

wherein said improved means to engage said improved means to engage said installed ceiling grid member comprises a clip on the same side of the device as said prong, said clip having a lower leg portion, an arcuate portion integral with said lower leg portion and an upper leg portion integral with said arcuate portion and extending therefrom to a free edge, with a gap between said lower and upper leg portion for receiving said ceiling grid molding therein.

3. An improved one piece device for piercing and hanging sheeting from an installed ceiling grid member, said device has a prong means to pierce and hang said sheeting and a means to engage said installed ceiling grid member, said improvement comprises a means to non-destructively slideably engage said ceiling grid member, said device hanging sheeting in contact with a wall onto which said ceiling grid member was installed so that said one piece device and said hanging sheeting may be sealed to said wall and said ceiling grid member by the application of pressure sensitive tape over said sheeting and device, said sealing of said device and said sheeting acting to isolate said wall as required for asbestos removal;

wherein said improved means to engage said installed grid member comprises a barb extending from the plane of said device on the same side as said prong, said barb having a straight free edge confronting and spaced from said prong, whereby said device is slideably insertable between said wall and installed ceiling grid member such that said barb engages a top edge of said grid member to support said device and said sheeting supported by said prong.

* * * * *